US007546878B2

(12) United States Patent
Prado et al.

(10) Patent No.: US 7,546,878 B2
(45) Date of Patent: Jun. 16, 2009

(54) CHEMICAL DEPLOYMENT CANISTERS FOR DOWNHOLE USE

(75) Inventors: Martin Prado, Houston, TX (US); Robert Krush, Sugar Land, TX (US); Ashish Sharma, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 187 days.

(21) Appl. No.: 11/639,031

(22) Filed: Dec. 14, 2006

(65) Prior Publication Data

US 2008/0142225 A1 Jun. 19, 2008

(51) Int. Cl.
*E21B 21/00* (2006.01)

(52) U.S. Cl. ..... 166/311; 166/242.1; 166/169

(58) Field of Classification Search ..... None
See application file for complete search history.

(56) References Cited

U.S. PATENT DOCUMENTS 3,692,106 A * 9/1972 Basham et al. ..... 166/53
4,386,655 A * 6/1983 Brandell ..... 166/106
4,676,306 A * 6/1987 Russell ..... 166/319
6,002,643 A * 12/1999 Tchakarov et al. ..... 367/85
6,131,661 A * 10/2000 Conner et al. ..... 166/300
6,143,698 A * 11/2000 Murphey et al. ..... 507/145
6,220,353 B1 4/2001 Foster
6,349,767 B2 * 2/2002 Gissler ..... 166/242.6
6,427,773 B1 * 8/2002 Albers ..... 166/185
6,527,048 B1 * 3/2003 Trosclair ..... 166/242.7
6,554,065 B2 * 4/2003 Fisher et al. ..... 166/253.1
6,568,472 B1 * 5/2003 Gano et al. ..... 166/207
6,626,241 B2 9/2003 Nguyen
6,776,240 B2 * 8/2004 Kenison et al. ..... 166/330
6,915,848 B2 * 7/2005 Thomeer et al. ..... 166/250.11
6,997,263 B2 * 2/2006 Campbell et al. ..... 166/374

(Continued)

FOREIGN PATENT DOCUMENTS

GB 2412390 A * 9/2005

(Continued)

OTHER PUBLICATIONS

Co-pending U.S. Appl. No. 11/610,600, filed Dec. 14, 2006 entitled, "Fluid Loss Control Agent with Triggerable Removal Machanism" by Hoeffer et al.

*Primary Examiner*—David J Bagnell
*Assistant Examiner*—James Sayre
(74) *Attorney, Agent, or Firm*—Edmonds PC; Jeremy P. Welch; James L. Kurka

(57) ABSTRACT

An apparatus for deployment of a reagent downhole includes a housing configured to move in a borehole; a chamber for storing the reagent, wherein the chamber is disposed in the housing and has one or more outlets for dispensing the reagent; a piston configured to move in the chamber; and a trigger mechanism. A method for deploying a reagent downhole includes disposing a tool downhole, wherein the tool comprises a canister storing the reagent, wherein the canister includes a housing configured to move in a borehole, a chamber for storing the reagent, wherein the chamber is disposed in the housing and has one or more outlets for dispensing the reagent, a piston configured to move in the chamber, and a trigger mechanism; and activating the trigger mechanism to move the piston to deploy the reagent.

16 Claims, 6 Drawing Sheets

U.S. PATENT DOCUMENTS

| | | | | |
|---|---|---|---|---|
| 7,117,947 | B2 * | 10/2006 | Wilson | 166/372 |
| 2002/0000320 | A1 * | 1/2002 | Gissler | 166/340 |
| 2004/0020652 | A1 * | 2/2004 | Campbell et al. | 166/313 |
| 2005/0022994 | A1 * | 2/2005 | Wilson | 166/305.1 |
| 2006/0243439 | A1 | 11/2006 | Hinds | |
| 2008/0002525 | A1 * | 1/2008 | Pratt et al. | 367/84 |
| 2008/0110617 | A1 * | 5/2008 | Giacomino | 166/250.1 |

FOREIGN PATENT DOCUMENTS

| | | | |
|---|---|---|---|
| WO | 01/34939 | A1 | 5/2001 |
| WO | 2004/039746 | A1 | 5/2004 |
| WO | 2005/028587 | A2 | 3/2005 |
| WO | 2005/106197 | A1 | 11/2005 |
| WO | 2006/041822 | A2 | 4/2006 |
| WO | 2006/075154 | A1 | 7/2006 |
| WO | WO 2006075154 | A1 * | 7/2006 |

* cited by examiner

CHEMICAL DEPLOYMENT CANISTERS FOR DOWNHOLE USE

BACKGROUND OF INVENTION

1. Field of the Invention

The invention relates generally to oil and gas production. Particularly, the invention relates to apparatus and methods for use in downhole operations.

2. Background of the Invention

Hydrocarbon fluids such as oil and natural gas are obtained from subterranean geologic formations by drilling a well that penetrates the hydrocarbon-bearing formations. Once a wellbore is drilled, the well must be completed before hydrocarbons can be produced from the well. Well completion may involve the design, selection, and installation of various equipment and materials in or around the wellbore for reinforcing the wellbore, conveying, pumping, or controlling the production or injection of fluids. After the well has been completed, production of oil and gas can begin.

One major objective in well completion is sand control. During production, sand or silt may flow into the wellbore from unconsolidated formations. This can lead to an accumulation of fill within the wellbore, reduced production rates and damage to subsurface production equipment. Migrating sand has the possibility of packing off around the subsurface production equipment, or may enter the production tubing and become carried into the production equipment. Due to its highly abrasive nature, sand contained within production streams can result in the erosion of tubing, flowlines, valves and processing equipment. The loss of material from the reservoir matrix can also lead to the movement and possible collapse of the reservoir. The problems caused by sand production and the deterioration of the reservoir support matrix can significantly increase operational and maintenance expenses and can lead to a total loss of the well.

One means of controlling sand production is the placement of relatively large grain sand or resin beads, referred to as gravel. The gravel serves to consolidate and prevent the movement of failed sandstone and/or increase the compressive strength of the formation sand. It can also serve as a filter to help assure that formation fines and formation sand do not migrate with the produced fluids into the wellbore. In a typical gravel pack completion, gravel is mixed with a carrier fluid and is pumped in a slurry mixture through a conduit, often drill pipe or coiled tubing, into the wellbore. The carrier fluid in the slurry is returned to the surface through a separate tubular or an annulus area, leaving the gravel deposited in the formation, perforation tunnels and wellbore where it forms a gravel pack. The carrier fluids may also leak into the formations, increasing the time and costs of performing gravel packing. Therefore, fluid loss control is often an integral part of gravel pack operations.

In addition to completion, specialized fluid loss control agents are used to control fluid loss during drilling, workover and stimulation operations. These fluid loss control agents are typically designed to control fluid losses for the duration needed in the applications. However, depending on the agents used in the fluid loss control compositions, these agents themselves may be damaging to the formations if allowed to remain in the formations. Therefore, when the fluid loss control is no longer needed, these fluid loss control agents may need to be removed so that they do not damage the formations. Removal of the fluid loss control agents typically involves pumping or adding a "breaker" to make the fluid loss control agents less viscous or more soluble.

In fluid loss control and many other downhole operations, controlled addition of chemicals and/or fluids is often required. These chemicals or fluids are typically pumped from the surface via tubings or conduits that extend to the desired zones in the wellbore. When pumped from the surface, a large volume will need to be pumped before the chemicals or reagents reach the desired zones. In addition, it is more difficult to time and quantify the chemicals or reagents that are needed. Therefore, there remains a need for better apparatus and methods that allow better control of deployment of chemicals or reagents downhole.

SUMMARY OF INVENTION

In one aspect, the present invention relates to apparatus for deployment of a reagent downhole. An apparatus in accordance with one embodiment of the invention includes a housing configured to move in a borehole; a chamber for storing the reagent, wherein the chamber is disposed in the housing and has one or more outlets for dispensing the reagent; a piston configured to move in the chamber; and a trigger mechanism.

In another aspect, the present invention relates to methods for deploying a reagent downhole. A method in accordance with one embodiment of the invention includes disposing a tool downhole, wherein the tool comprises a canister storing the reagent, wherein the canister includes a housing configured to move in a borehole, a chamber for storing the reagent, wherein the chamber is disposed in the housing and has one or more outlets for dispensing the reagent, a piston configured to move in the chamber, and a trigger mechanism; and activating the trigger mechanism to move the piston to deploy the reagent.

Other aspects and advantages of the invention will be apparent from the following description and the appended claims.

DETAILED DESCRIPTION

Embodiments of the invention relate to canisters for deployment of chemicals, solutions, emulsions, suspensions, and the like downhole. Canisters in accordance with embodiments of the invention may be disposed on a downhole tool, tubing or pipe, such as a wash pipe of a sand control service tool. Such canisters may include mechanisms for triggering the deployment of the reagents at the desired time. These canisters can be used to dispense reagents or chemicals for various purposes, for example, to break fluid loss control agents in gravel packing operations or the like. For brevity of description, "canister" will be broadly used to describe various apparatus of the invention that include chambers for storing and dispensing reagents, chemicals, fluids, or the like.

In accordance with embodiments of the invention, a canister for downhole use may be incorporated into a downhole tool, for example in the collar or housing of a downhole tool or tubing. Various downhole tools and tubing strings can potentially be modified to have a chamber (container or canister) for deployment of chemicals and reagents in accordance with embodiments of the invention. While embodiments of the invention may be used with various downhole tools or tubings, for clarity, the following description mainly uses tools and tubings used in gravel packing to illustrate embodiments of the invention.

Figure 1:
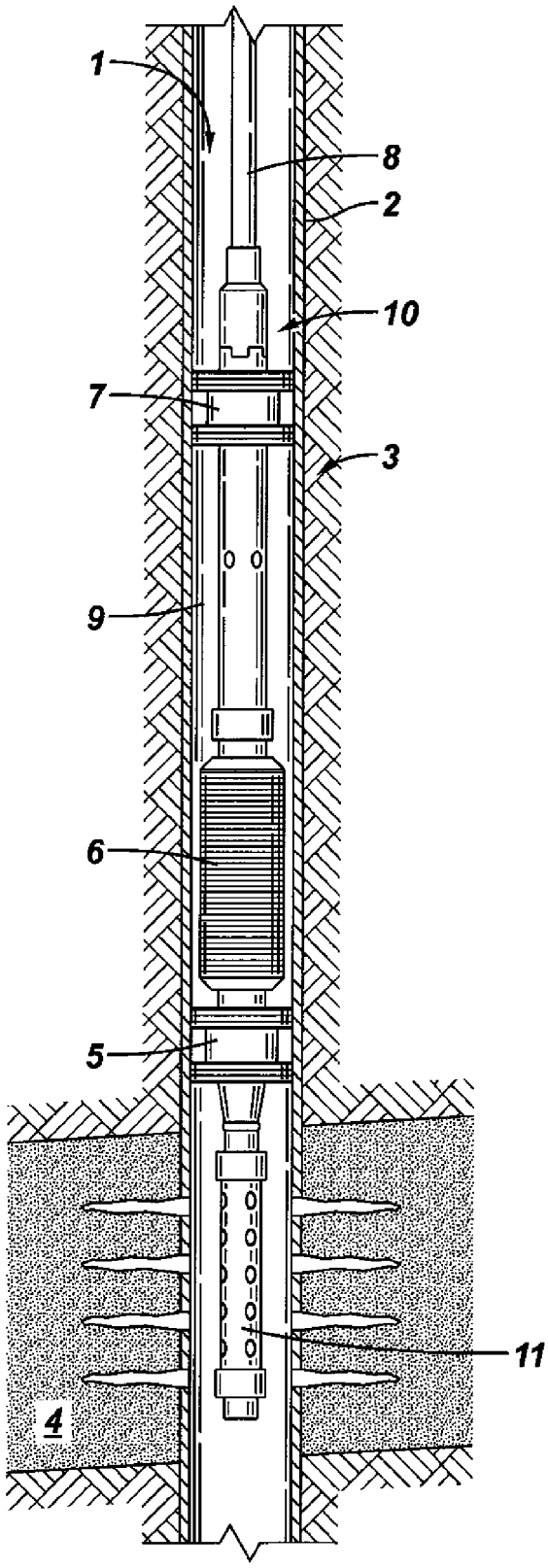
FIG. 1 shows a prior art sand control tool disposed in a wellbore.

An example of a downhole tool used in gravel packing may be found in U.S. Pat. No. 6,220,353 issued to Foster et al., which discloses a full bore set down (FBSD) tool assembly for gravel packing in a well. This patent is assigned to the present assignee and is incorporated by reference in its entirety. FIG. 1 shows a schematic of a service string 3 disposed in a wellbore 1. The service string 3 includes a perforating gun 11 aligned with the zone to be produced, a bottom packer 5, a sand screen 6, a gravel pack tool assembly 10, and a tool assembly packer 7. The service string 3 is supported by a tubing string 8 extending to the surface. In this embodiment, the perforating guns are fired to perforate the production zone. Then, the service string 3 is lowered to align the packers 5,7 above and below the perforations, and then the packers 5,7 are set to isolate the production zone and define an annulus area between the service string 3 and the casing 2. The gravel packing is then performed and the zone produced.

A typical gravel pack operation includes three operations (among others) referred to as the squeeze operation, the circulating operation, and the reverse operation. In the squeeze operation, the gravel slurry is forced out into the formation 4 by pumping the slurry into the production zone while blocking a return flow path. The absence of a return flow path causes the pressure to build and force the slurry into the formation 4. When the void spaces within the formation 4 are "filled," the pressure will rise quickly, referred to as "tip screen out." Upon tip screen out, the next typical step is to perform a circulating operation in which the gravel slurry is pumped into the annular area between the sand screen 6 and the casing 2. In the circulating position, the return flow path is open and the return fluid is allowed to flow back to the surface. The sand screen 6 holds the gravel material of the gravel slurry in the annular area, but allows fluids to pass therethrough. Thus, circulating the gravel slurry to the sand screen 6 deposits the gravel material in the annular area. However, during the circulating operation, when the deposited gravel material reaches the top of the sand screen 6, the pressure will rise rapidly, indicating screen out and a full annulus. Note that an alternative manner of operating the tool is to perform the squeeze operation with the tool assembly 10 in the circulate position and with a surface valve (not shown) closed to prevent return flow. Using this method, the shift from the squeeze operation to the circulate operation may be made by simply opening the surface valve and without the need to shift the tool.

When the annulus is packed, the string may be pulled from the wellbore 1. However, to prevent dropping of any gravel material remaining in the service string 3 and the tubing 8 into the well when pulling the string from the well, the gravel in the tubing 8 and service string 3 is reverse circulated to the surface before the string is removed. This procedure of reverse circulating the remaining gravel from the well is referred to as the reverse operation. In general, the flow of fluid is reverse circulated through the tubing 8 to pump the gravel remaining in the tubing string 8 and service string 3 to the surface.

As noted above, during gravel packing operations, it might be necessary to control fluid loss into the formations. The most commonly used fluid loss control agents are based on HEC or other modified guars. These fluid loss control agents will need to be removed when they are no longer needed so that they will not damage the formations. Before these agents can be removed, a breaker (typically an acid) is used to break the crosslinking of these polymers so that they will have lower viscosity and will be easier to remove. In these operations, various fluids will need to be pumped to the zone under treatment. However, pumping the fluids from the surface is not economical; it is time consuming and it requires a large volume of the fluids. In contrast, using canisters of the invention can greatly facilitate these operations.

Canisters in accordance with embodiments of the invention may be used with various downhole tools or tubings, such as the tool assembly 10 shown in FIG. 1. The general features of a canister of the invention may include: a chamber (e.g., an annular chamber), a piston that can slide in the chamber, a mechanism to activate (push) the piston, and one or more outlets (ports) to dispense the content stored in the chamber.

Figure 2:
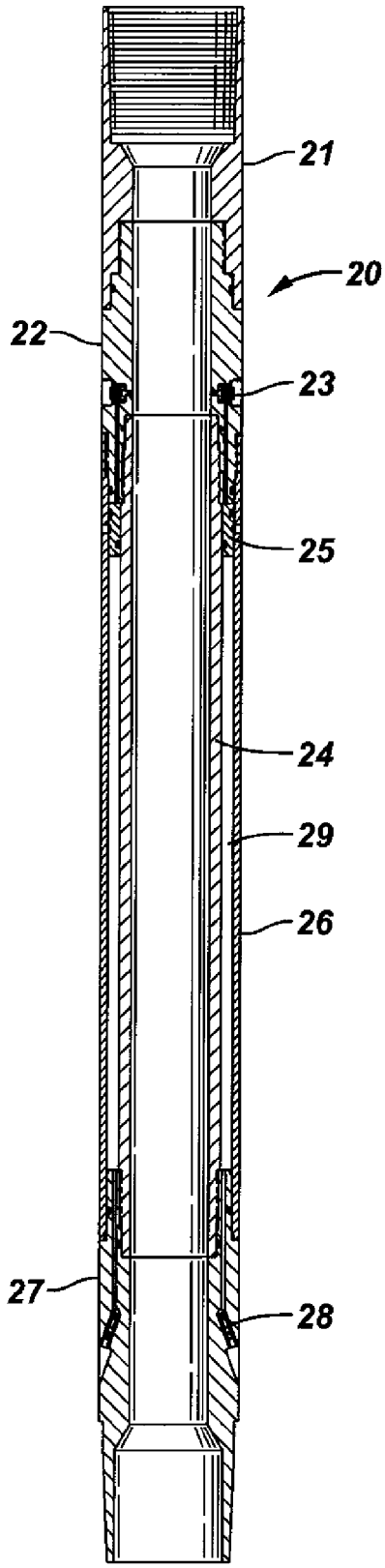
FIG. 2 shows a wash pipe having a canister for deployment of chemicals in accordance with one embodiment of the invention.
Figure 3:
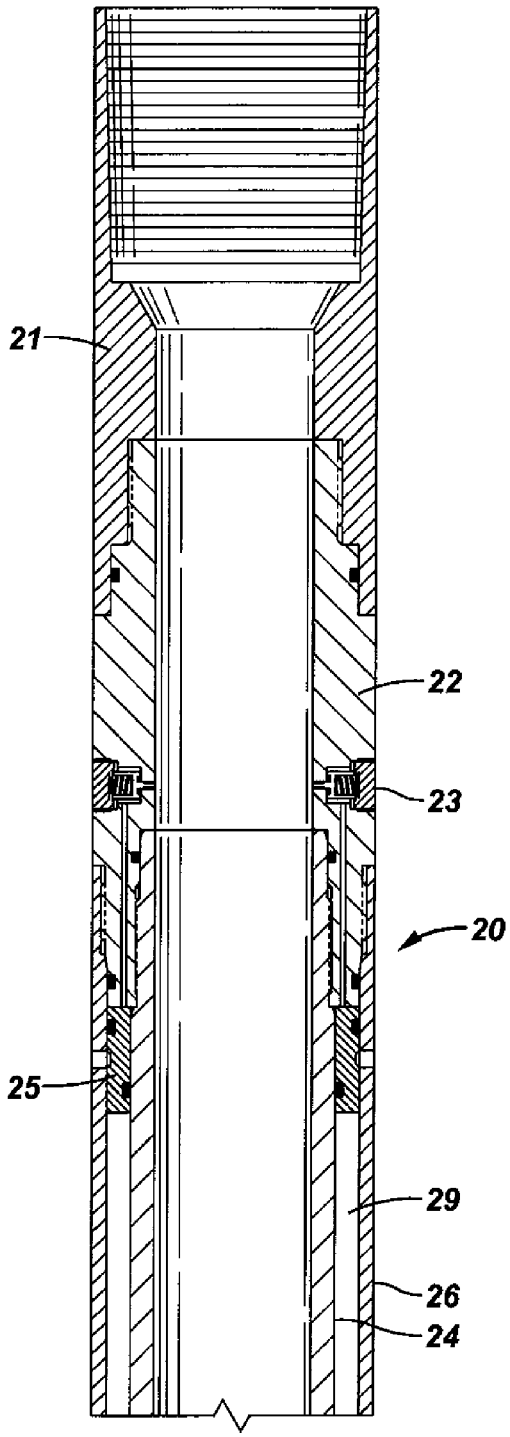
FIG. 3 shows an expanded view of a section of the tool of FIG. 2.
Figure 4:
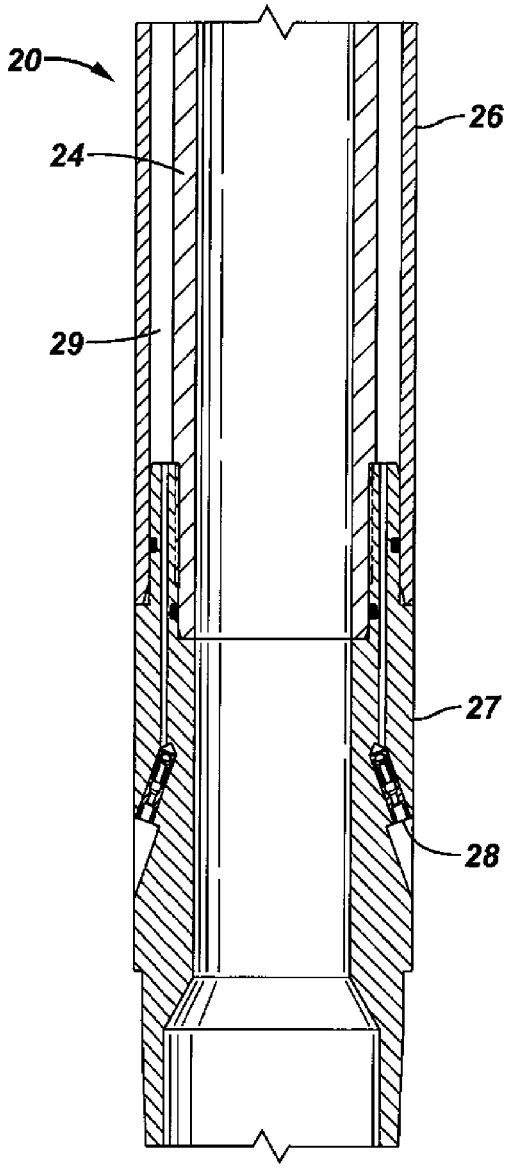
FIG. 4 shows an expanded view of another section of the tool of FIG. 2.

FIG. 2 shows an example of a downhole tubing string (e.g., a wash pipe) incorporating a canister of the invention. FIGS. 3 and 4 show sections of the same tool in expanded views. In this particular example, the downhole tool or tubing is a wash pipe, which is shown as having a box x pin joint. However, in other embodiments, the canisters may be incorporated into other downhole tools or tubings.

Figure 6:
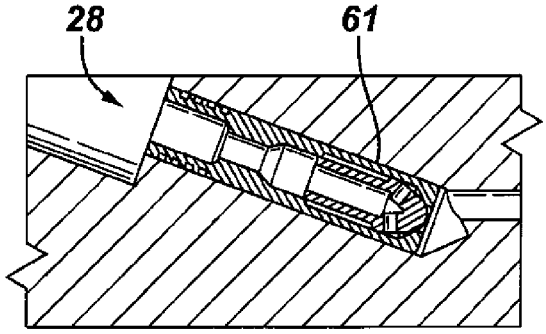
FIG. 6 shows an injection port in accordance with one embodiment of the invention.

As shown in FIGS. 2-4, a downhole tool 20 comprises: an upper sub 21 with a premium flush thread, a crossover 22 containing a modified poppet valve 23 (which will be described in more detail with reference to FIG. 7) for activation at selected depth (or pressure), a mandrel 24, a free-floating piston 25 located inside a pressure-containing housing 26 and mounted on the outside (od) of the mandrel 24, and a lower sub 27 containing one or more injection ports 28 to allow the chemical/acid to be dispersed. As shown in FIG. 6, the injection port 28 includes a check valve 61 to allow the chemicals to be dispensed outward, while preventing outside fluids from entering the canister. The space between the housing 26 and mandrel 24 defines a chamber 29 for storing chemicals. Note that in some embodiments, the housing 26 and the mandrel 24 may be an integral part. In this case, the chamber 29 may be viewed as disposed inside the wall of the housing 26.

Figure 5:
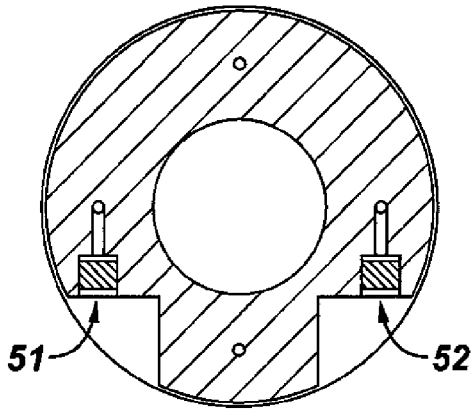
FIG. 5 shows a cross section of a tool, illustrating fill and bleed ports, in accordance with one embodiment of the invention.

The lower sub 27 may also contain a fill port and a bleed port and a premium flush thread. FIG. 5 shows an expanded section of the lower sub 27, illustrating the fill port 51 and the bleed port 52. Note that the fill port 51 and the bleed port 52 may also be disposed at other locations of the canister, for example in the upper sub 21 or in the housing 26 between the upper sub 21 and the lower sub 27. The fill port 51 and the bleed port 52 allow the chemicals to be filled in the annular chamber 29 between the housing 26 and the mandrel 24 and in front of the piston 25.

Figure 7:
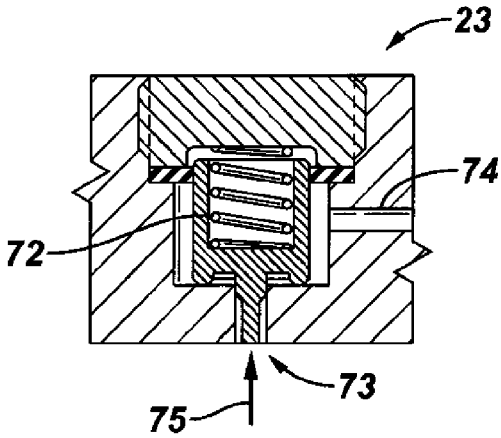
FIG. 7 shows a modified poppet valve in accordance with one embodiment of the invention.

FIG. 7 shows an expanded view of a modified poppet valve 23 that may be used with canisters of the invention. The poppet valve 23 has an opening 73 that faces the lumen of the tubing. In the closed state, the spring 72 pushes a plug to seal the opening 73. When the pressure inside the tubing is high enough to push open the opening 73, the pressure will be conducted to the conduit 74 to push the piston (shown as 25 in FIG. 2) to dispense the chemicals. Note that the poppet valve shown in FIG. 7 is an example. Other devices, including mechanically operated ones, may also be used. For example, the poppet valve may be replaced with any valve (e.g., a ball valve or a sleeve valve) that is suitable for downhole use. Such other valves may be opened and closed by operating a shifting tool, which may be attached in the lumen of the tubing.

As shown in FIG. 2, a canister of the invention may be incorporated into a housing of a downhole tubing or a tool (including a collar). In this particular embodiment, the piston and the chamber for storing the chemicals or reagents have an annular shape—along the circumference of the housing. However, other embodiments may have different shapes. For example, the annular shape as shown in FIG. 2 may be divided into two semispherical shapes or a plurality of tubular shapes in the wall of the housing. While the example in FIG. 2 has the canister designed inside the housing of the wash pipe, in other embodiments, a canister of the invention may be a separate part disposed on the inside (lumen) or outside of a tubing or a downhole tool.

A canister of the invention may be dimensioned to suit the purposes of the selected operations. How to determine a suitable dimension is known to one skilled in the art. For example, a canister in accordance with embodiments of the invention for use in gravel packing may be designed to dispense a selected volume (e.g., about 5 $in^3$ or about 82 cc) of a chemical per foot of screen run. Chemicals to be used with such a canister may be a solution, suspension, emulsion, gel or the like. For use in breaking an HEC based fluid loss control agent, acids are typically used. Suitable acids may include, for example, citric, maleic, and lactic acids.

Canisters in accordance with embodiments of the invention are intended to be used downhole. Therefore, such canisters preferably can withstand the downhole conditions, such as high pressures (e.g., 9000 psi) and high temperatures (e.g., 250° F. or 121° C.). In addition, canisters in accordance with embodiments of the invention preferably do not interfere with other downhole operations, such as gravel pack operations. Furthermore, such tools preferably do not increase friction pressure such that they do not interfere with other downhole operations. In this regard, preferred embodiments may have canisters of the invention incorporated in the housing wall or in a configuration that does not substantially reduce the opening of the lumen, as shown in FIG. 2. Common wash pipes have diameters between 2 and 4 in (about 5-10 cm) for use in cased holes.

Figure 8:
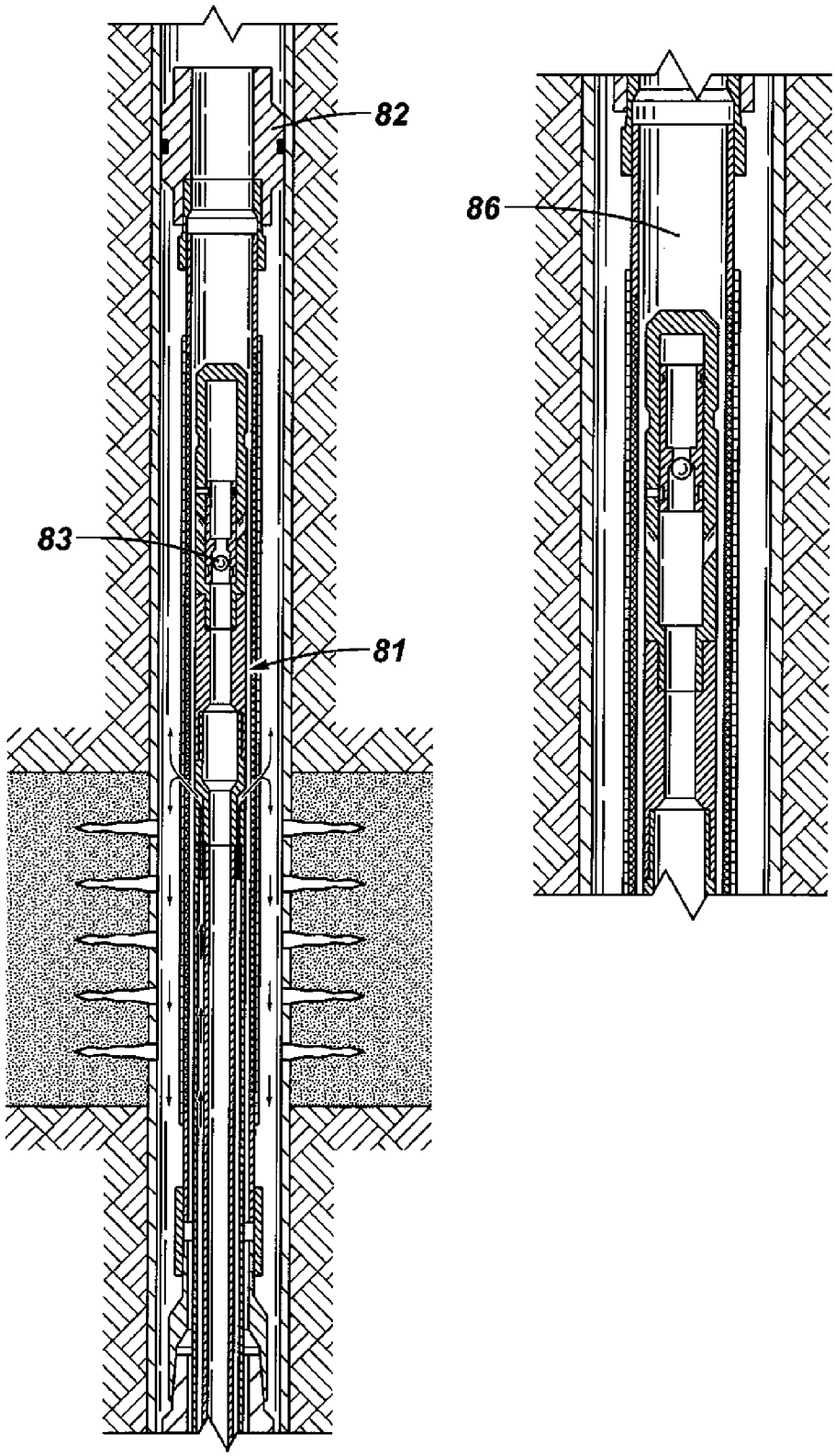
FIG. 8 shows a downhole tool, illustrating deployment of a canister of the invention.

With reference to FIG. 8, using a sand control service tool 81, specifically a Full Bore Set Down (FBSD) tool, as an example, deployment of a canister of the invention during gravel packing will be described to illustrate its use. After the casing is run in hole and perforated, the perforated zones may be treated with a fluid loss control agent (such as CleanSEAL® from Schlumberger) before the gravel packing operation is started.

For gravel packing or sand control, a completion string, including a service tool 81, packers 82 and screens, is run in hole. After the packers 82 are set, the service tool 81 is released and the completion string may be pulled out of the hole. Next, the free-floating ball valve 83 is opened to allow the inside of the service tool 81 to communicate with the annulus 86. Then, the slurry for gravel packing may be pumped to perform the packing operations.

When it is time to break the fluid loss control agent (such as CleanSEAL®), the chemicals are discharged from the canister by pressuring against the free-floating ball valve 83 in the wash pipe. This closes the communication between the inside of the pipe to the annulus 86, leading to increased pressure inside the pipe. The increased pressure inside the pipe then activates the canisters, for example by opening a poppet valve shown in FIG. 7.

The service tool 81 may have a flow-by check valve with a shear sleeve below the canisters to allow flow back. The canisters are allowed to remain open for a specified duration to dispense the chemicals. When the chemical deployment is complete, the free-floating ball valve 83 is opened again to allow for live annulus pressure, and then packing operation can be continued.

With reference to FIG. 2 and FIG. 7, one example of specific operations of a canister of the invention is as follows. First, the pressure of the internal lumen of the tube that includes the canister is increased. The increased pressure inside the tubing pushes open the poppet valve (shown as 23 in FIG. 2 and FIG. 3). Referring to FIG. 7, the hydraulic pressure 75 pushes against a plug that blocks the opening 73 of the poppet valve, allowing the pressure to be transduced to the conduit 74 to push the piston (shown as 25 in FIG. 2 and FIG. 3). The poppet valve may be adjusted to operate under the pressure expected downhole. When the piston 25 is pushed, it slides along the annular chamber 29 to push out the chemicals stored in the annular chamber 29. The chemicals are dispensed through injection ports 28.

In addition to pressure activation, the activation of the canister may also be accomplished by mechanical means. As shown in FIG. 7, a mechanical device may generate a mechanical force to push against the opening 73 of the poppet valve. The mechanical means, for example, may be a shifting tool arranged on the inside (lumen) of the tool. The shifting tool may be pulled or pushed to activate the canisters. The use of a shifting tool to activate a device downhole is well known in the art.

Figure 9:
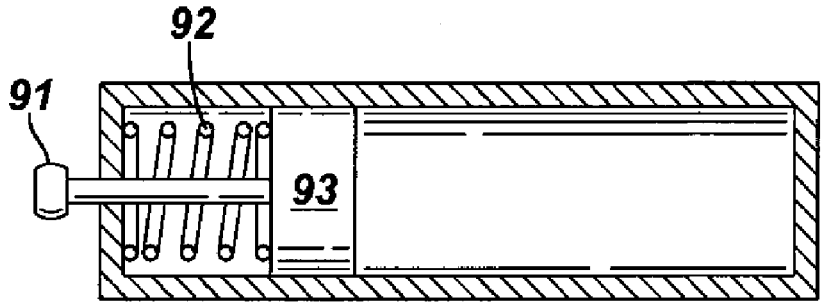
FIG. 9 shows a canister having a mechanical trigger mechanism in accordance with one embodiment of the invention.

FIG. 9 shows a schematic illustrating one embodiment of a mechanical means that can be used to control the activation of a canister of the invention. As shown, a stopping mechanism 91 prevents the piston 93 from sliding to the right. The piston 93 is biased to move to the right in this illustration by a biasing spring 92 (or a similar mechanism). If a shifting tool (or other device) is used to release the stopping mechanism 91, the free-floating piston 93 in the canister will start to move to dispense the content of the canister. This is only one example of how a mechanical means may be used with a canister of the invention. One of ordinary skill in the art would appreciate that other variations are possible without departing from the scope of the invention.

In accordance with some embodiments of the invention, multiple canisters may be incorporated in a single wash pipe (or other tubings) or a downhole tool. The multiple canisters (or cartridges) may be filled with same or different chemicals or reagents. These cartridges may have individual pistons for deploying chemicals when pressured against or shifted by set down or pull force by using a shifting tool.

As noted above, embodiments of the invention may be used to dispense chemicals or reagents for various purposes downhole, the use of sand control (e.g., gravel packing) and wash pipe in the above illustration is not intended to limit the scope of the invention. For example, embodiments of the invention may also be used to release a reagent to break a kill pill or other fluid control agents. Reagents for breaking fluid control agents or kill pills would depend on the chemical properties of the fluid loss control agents. For example, for HEC or guars based agents, the breakers may be acids (e.g., HCl or acetic acid). In a co-pending-application entitled, "Fluid Loss Control Agent with Triggerable Removal Mechanism," by Hoeffer et al., filed around the filing date of the present application, discloses a new type of fluid control agents that include hydrolyzable functional groups, which can be hydrolyzed on demand to facilitate the removal of the fluid loss control agents. Embodiments of the invention can provide "on demand" release of a base (e.g., NaOH) or a nucleophile (e.g., $R—NH_2$) to facilitate the breaking of such fluid loss control agents.

Similarly, embodiments of the invention may be used to release a reagent that breaks a filter cake. One of ordinary skill in the art would appreciate that reagents for breaking filter cakes would depend on the properties of the materials that make up the filter cakes. For example, enzymes may be used to break up guar polymer filter cakes. Other reagents for breaking filter cakes known in the art, for example, may include oxidizers, acids, and chelating agent solutions. In another example, embodiments of the invention may be used to release friction reducing agents (friction reducers) to facilitate gravel packing of long intervals. Useful friction reducers, for example, may include long chain polymers including, polyacrylamide, polyethylene oxide, emulsified form of such polymers and surfactant solutions.

Figure 10:
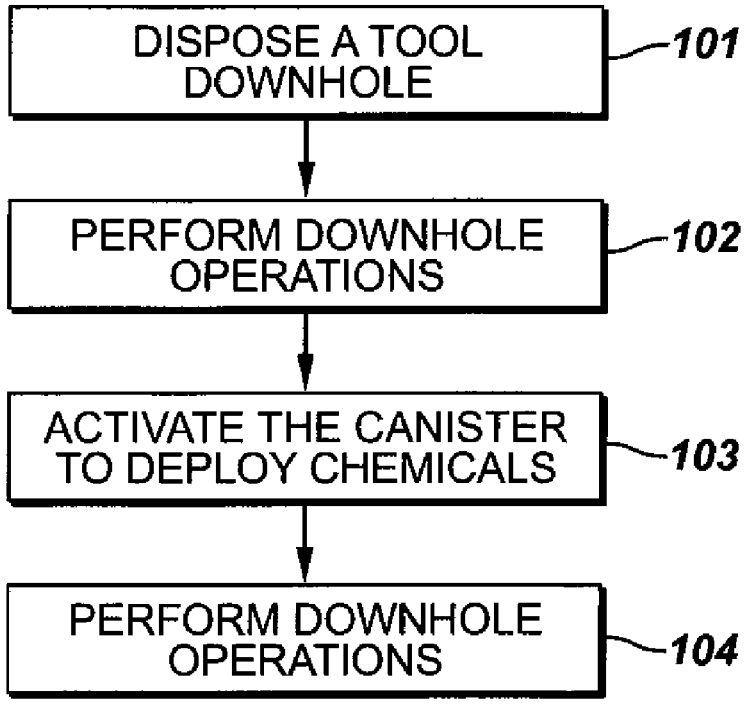
FIG. 10 shows a flow chart illustrating a method in accordance with one embodiment of the invention.

FIG. 10 illustrates a general process for performing a downhole operation using a canister of the invention. As shown, a tool for performing the downhole operation is first set downhole (step 101). The tool includes a canister of the invention, which may store some chemicals for use downhole. Then, some operations may be performed using the tool (step 102). When deployment of the chemical is desired, the canister is activated (step 103). Activation of the canister, as noted above, may be accomplished by various means. After deployment of the chemicals, the downhole operations may be continued if needed (step 104). Afterwards, the tool may be pulled out of the hole. The process illustrated in FIG. 10 is for illustration purpose only. One of ordinary skill in the art would appreciate that modifications to this process are possible without departing from the scope of the invention.

Embodiments of the invention may have one or more of the following advantages. Canisters of the invention allow timely deployment of the reagents or chemicals downhole. Thus, addition of chemicals downhole may be "on demand" by a signal from the surface. The canisters allow concentrated reagents or chemicals to be released in the zones of their intended use, increasing the efficiency of chemical deployment. This also saves time and costs because there is no need to pump a large volume from the surface. Canisters of the invention may be constructed on any downhole tool or tubings. They can be configured to have minimal impact on the normal operations downhole or to have minimal impact on fluid flow resistance. Multiple canisters may be used, allowing deployment of different chemicals in different zones and/or different times.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus for deployment of a reagent downhole, comprising:

a housing member disposed about a mandrel, wherein the mandrel has an inner bore formed therethrough;

a chamber formed between the mandrel and housing, and wherein the chamber has one or more outlets for dispensing the reagent;

a piston configured to move in the chamber, wherein the piston is in selective communication with the inner bore of the mandrel; and a trigger mechanism.

2. The apparatus of claim 1, wherein the housing is part of a downhole tool.

3. The apparatus of claim 1, wherein the housing is part of a tubing string.

4. The apparatus of claim 3, wherein the tubing string is a wash pipe.

5. The apparatus of claim 1, wherein the trigger mechanism comprises a poppet valve.

6. The apparatus of claim 1, wherein the trigger mechanism comprises a mechanical mechanism.

7. The apparatus of claim 1, wherein the chamber is disposed inside a wall of the housing.

8. The apparatus of claim 1, wherein at least a portion of the trigger mechanism is disposed radially through the mandrel between the inner bore and the chamber.

9. A method for deploying a reagent downhole, comprising:

locating a tool in a wellbore, wherein the tool comprises a canister comprising:

a housing member disposed about a mandrel, wherein the mandrel has an inner bore formed therethrough, a chamber formed between the mandrel and housing, and wherein the chamber has one or more outlets for dispensing the reagent, a piston configured to move in the chamber, wherein the piston is in selective communication with the inner bore of the mandrel, and a trigger mechanism; and activating the trigger mechanism to move the piston to deploy the reagent.

10. The method of claim 9, wherein the trigger mechanism comprises a poppet valve.

11. The me hod of claim 9, wherein the trigger mechanism comprises a mechanical mechanism.

12. The method of claim 9, wherein the tool is for gravel packing or sand control.

13. The method of claim 9, wherein the canister is disposed on a tubing connected to the tool.

14. The method of claim 9, wherein the canister is disposed on a wash pipe run in hole with the tool.

15. The method of claim 9, wherein the reagent is for breaking a kill pill or for breaking a filter cake.

16. The method of claim 9, wherein the reagent is a friction reducer.

* * * * *